US006125545A

United States Patent [19]

Yamaguchi et al.

[11] Patent Number: 6,125,545

[45] Date of Patent: Oct. 3, 2000

[54] HAIR CUTTER

[75] Inventors: Naoki Yamaguchi, Hikone; Shinji Yamamoto, Yokohama; Etsushi Muramatsu, Neyagawa, all of Japan

[73] Assignee: Matsushita Electric Works, Ltd., Osaka, Japan

[21] Appl. No.: 09/332,887

[22] Filed: Jun. 15, 1999

[51] Int. Cl.[7] ..... B26B 19/38

[52] U.S. Cl. ..... 30/233.5

[58] Field of Search ..... 30/200–202, 233.5, 30/30, 31

[56] References Cited

U.S. PATENT DOCUMENTS 4,776,095 10/1988 Tsujimoto et al. ..... 30/201
5,898,999 5/1999 Chaouachi et al. ..... 30/200 X

FOREIGN PATENT DOCUMENTS 6-134149 5/1994 Japan ..... 30/233.5

*Primary Examiner*—Douglas D. Watts
*Attorney, Agent, or Firm*—Armstrong, Westerman, Hattori, McLeland & Naughton

[57] ABSTRACT

A hair cutter according to the present invention includes a hair cutter body having a generally rectangular cross-section, a hair cutting portion provided at one end thereof, a comb portion having a plurality of comb plates for covering the hair cutting portion, and a comb portion holder having the comb portion at one end thereof. The hair cutter body has side surfaces disposed along a direction of thickness. The hair cutting portion includes a comb-like fixed blade and a comb-like movable blade reciprocating relative to the comb-like fixed blade. The comb portion holder has at least one supporting member fitted on and rotatably attached to the side surface. The comb portion holder is allowed to rotate in a plane parallel to the side surfaces so that the comb portion is capable of changing its position between a comb-use-position where the comb portion covers the hair cutting portion and a non-comb-use-position where the comb portion is placed at the other end of the hair cuter body with the hair cutting portion exposed.

16 Claims, 17 Drawing Sheets

HAIR CUTTER

BACKGROUND OF THE INVENTION

1. Field of the Invention

This invention generally relates to a hair cutter, and more particularly, to a hair cutter having a hair cutter body with a hair-cutting portion at one end thereof, and a comb portion for covering the hair cutting portion, wherein the comb portion can change its position between a comb-use-position where the comb covers the hair cutting portion and a non-comb-use-position where the comb is positioned at the other end of the hair cutter body with the hair cutting portion exposed.

2. Description of the Related Art

An example of this kind of hair cutter is disclosed in Japanese Utility Model Unexamined Laid-open Publication No. Sho 63(1988)-19024. As shown in FIG. 18, the hair cutter includes a hair cutter body 4 having a generally rectangular cross-section and a hair cutting portion 3 provided at a longitudinal end thereof with an inclined state. The hair cutting portion 3 is comprised of a comb-like fixed blade 1 and a comb-like movable blade 2 fitted on the inside surface of the fixed blade 1 in a reciprocative manner. In addition, the hair cutter also includes a comb portion 5 having a plurality of comb plates. In a case where the comb portion 5 covers the hair cutting portion 3 from the fixed blade side, the comb portion 5 adjusts the length of hair cut by the hair cutting portion 3. The comb portion 5 is provided at one end portion of a U-shaped comb portion holder having a pair of right and left legs S. The ends of the legs S of the U-shaped comb portion holder are rotatably connected to the lateral sides of the hair cutter body 4 so that the holder can rotate around the rotation axis X shown in FIG. 18. Thus, the comb portion holder is allowed to rotate in a plane parallel to the lateral side surfaces of the hair cutter body 4.

The comb portion holder can change its position from a comb-use-position shown by an actual line in FIG. 18 to a non-comb-use-position shown by a phantom line in FIG. 18 by rotating the comb portion holder in the direction shown by arrow A. At the comb-use-position, the hair cutting portion 3 is covered by the comb portion 5. At the non-comb-use-position, the comb portion 5 is placed at the other end of the hair cuter body 4 with the hair cutting portion 3 exposed. By rotating the holder in a reverse direction from the non-comb-use-position, the holder returns to the comb-use-position.

When the hair cutter is used in a state that the hair cutting portion 3 is covered by the comb portion 5, the hair cutter body 4 is moved along a user's head in the direction shown by arrow B in FIG. 18. In this case, a rotational force in a direction opposite to the moving direction B of the hair cutter body 4 is imparted to the comb portion 5, which may cause unintentional rotation of the holder. Thus, the comb portion 5 may unexpectedly move to expose the hair cutting portion 3, resulting in an unstable hair cutting operation.

SUMMARY OF THE INVENTION

An object of the present invention is to provide a hair cutter with a comb portion which does not unexpectedly move away from a hair cutting portion when the comb portion is in use.

According to the present invention, the hair cutter includes a hair cutter body having a generally rectangular cross-section, the hair cutter body having side surfaces located along a direction of thickness, a hair cutting portion provided at one end of the hair cutter body, the hair cutting portion including a comb-like fixed blade and a comb-like movable blade reciprocating to the comb-like fixed blade, a comb portion having a plurality of comb plates for covering the hair cutting portion, and a comb portion holder having the comb portion at one end thereof. The comb portion holder has at least one supporting member fitted on and rotatably attached to the side surface of the hair cutter body, whereby the comb portion holder is allowed to rotate in a plane parallel to the side surfaces so that the comb portion is capable of changing its position between a comb-use-position where the comb portion covers the hair cutting portion and a non-comb-use-position where the comb portion is placed at the other end of the hair cuter body with the hair cutting portion exposed.

With this hair cutter, the comb portion is allowed to rotate only in a plane parallel to the side surfaces located in the direction of the hair cutter body. Thus, in a case where a comb portion covers the hair cutting portion, although a load is imparted to the comb portion when in use, the comb portion holder is effectively prevented from unexpectedly rotating relative to the hair cutter body by the load. This enables a stable hair cutting operation.

According to another aspect of the present invention, a hair cutter includes a hair cutter body having certain thickness, a hair cutting portion provided at one longitudinal end of the hair cutter body, a comb portion holder having a comb portion including a plurality of comb plates at one end thereof for covering the hair cutting portion, wherein the comb portion holder is connected to the hair cutter body such that the comb portion holder is allowed to rotate about a hypothetical axis penetrating the hair cutter body along a direction of thickness. Accordingly, the comb portion can change its position between a comb-use-position where the comb portion covers the hair cutting portion and a non-comb-use-position where the comb portion is placed at the other end of the hair cuter body with the hair cutting portion exposed.

With this hair cutter, in a case where a comb portion covers the hair cutting portion, although a load is imparted to the comb portion when in use, the comb portion holder is effectively prevented from unexpectedly rotating relative to the hair cutter body by the load. This also enables a stable hair cutting operation.

According to still another aspect of the present invention, a hair cutter includes a hair cutter body, a hair cutting portion provided at one end of the hair cutter body, and a comb portion holder having a comb portion at the other end thereof. The comb portion holder is connected to the hair cutter body such that the comb portion holder is allowed to rotate in a direction perpendicular to a direction of load imparted to the comb portion holder, whereby the comb portion can change its position between a comb-use-position where the comb portion covers the hair cutting portion and a non-comb-use-position where the comb portion is placed at the other end of the hair cuter body with the hair cutting portion exposed.

With this hair cutter, in a case where the comb portion covers the hair cutting portion, although a rotational load is imparted to the comb portion when in use, the comb portion holder is effectively prevented from unexpectedly rotating relative to the hair cutter body by the rotational load. This also enables a stable hair cutting operation.

Other objects and advantages of the present invention will become apparent from the description of the preferred embodiments, which may be modified in any manner without departing from the scope and spirit of the present invention.

DETAILED DESCRIPTION OF THE PREFERRED EMBODIMENTS

Preferred embodiments of a hair cutter, according to the present invention, will now be described in detail, with reference to the accompanying drawings.

FIGS. 1–9 show a hair cutter according to a first embodiment of the present invention.

The hair cutter A is comprised of a hair cutter body 4 having a rectangular cross-section and a comb portion holder 7 rotatably attached to the hair cutter body 4. The hair cutter body 4 has a hair cutting portion 3 at one longitudinal end portion thereof. The comb portion holder 7 has a comb portion 5 at one end portion thereof.

Figure 4:
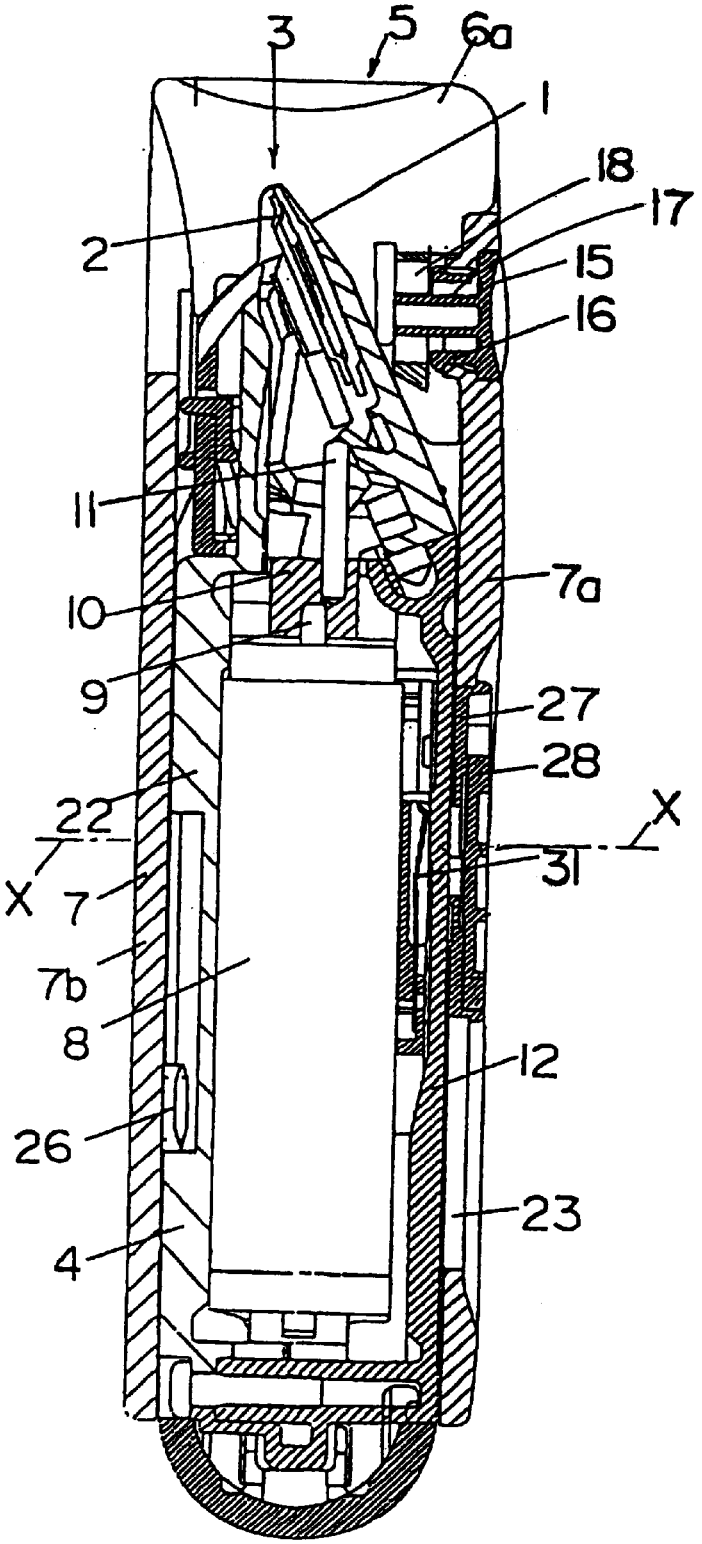
FIG. 4 is an enlarged cross-sectional view taken along the lines 4—4 of FIG. 3A.

As shown in FIG. 4, the hair cutting portion 3 is provided at an end portion of the hair cutter body 4 at an inclined state. The hair cutting portion 3 includes a comb-like fixed blade 1 and a comb-like movable blade 2 fitted on the fixed blade 1 in a reciprocative manner. The movable blade 2 is driven to reciprocate by an electric motor 8 in the hair cutter body 4. In detail, the movable blade 2 is driven to reciprocate by way of an eccentric cum 10 connected to an output axis 9 of the motor 8 and an eccentric axis 11 connected to the eccentric cum 10 so as to cut a user's hair in corporation with the fixed blade 1.

Figure 5:
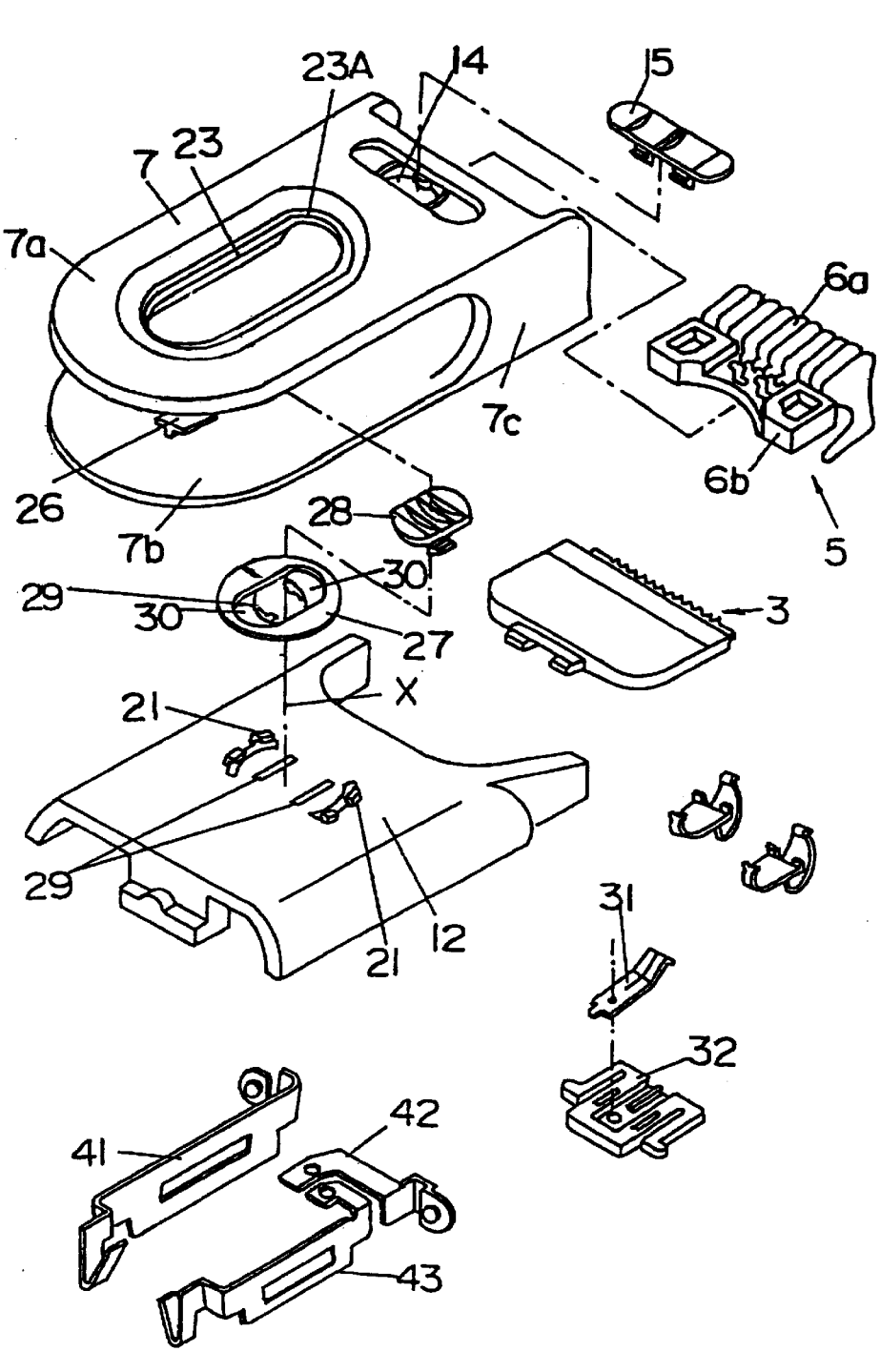
FIG. 5 is an exploded perspective view showing parts of the hair cutter shown in FIG. 1A.

As clearly shown in FIG. 5, the comb portion holder 7 is of generally U-shaped and has a pair of supporting plates 7*a* and 7*b* disposed in parallel with each other at a distance and a connecting portion 7*c* connecting the end portions of the supporting plates 7*a* and 7*b*.

Figure 9:
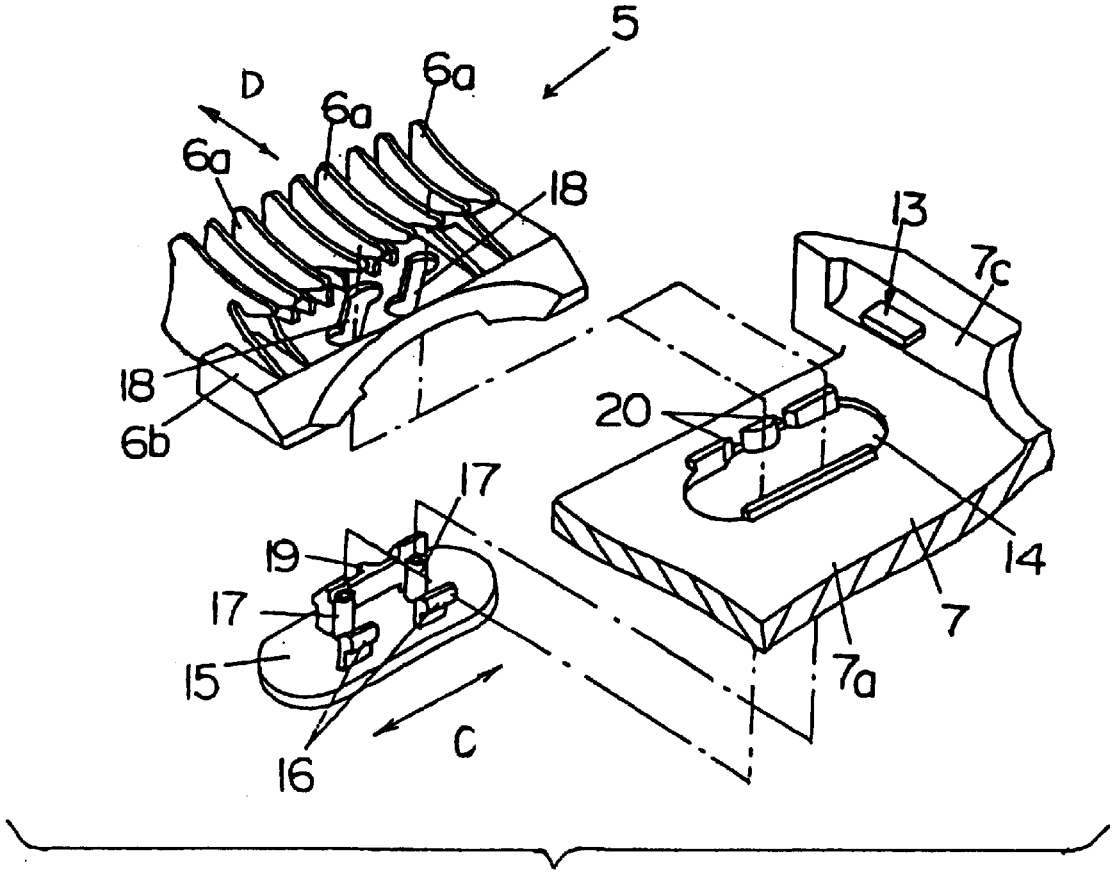
FIG. 9 is a perspective view of the comb portion and its adjacent parts of the hair cutter shown in FIG. 1 in a disassembled state.

The comb portion 5 is comprised of a plurality of comb plates 6*a* each disposed in a direction perpendicular to the reciprocative direction of the movable blade 2 and a base portion 6*b* connecting the comb plates 6*a*. As shown in FIG. 9, the comb portion 5 is held in the comb portion holder 7 with the base portion 6*b* guided by the guide members 13 formed on inner surfaces of the connecting portions 7*c* of the comb portion holder 7 so that the comb portion 5 can move along a direction of height of the comb plates 6.

One of the supporting plates 7*a* of the comb portion holder 7 is provided with a laterally elongated circular opening 14 at one end portion of the supporting plate 7*a*. An operation plate 15 is slidably fitted in the opening 14 with guide means such as engaging legs 16 engaged with the periphery of the opening 14.

The operation plate 15 has a pair of bosses 17 each engaged with a corresponding slanted guide slit 18 formed in the base portion 6*b* of the comb portion 5. By sliding the operation plate 15 in the direction of arrow C shown in FIG. 9, the comb portion 5 is moved in the direction of arrow D shown in FIG. 9. The operation plate 15 has a bulged portion 19 for resiliently engaging with one of right and left dented portions 20 formed on an edge portion of the elongated circular opening 14 so as to position the operation plate 15 at one of two positions. Therefore, the comb portion 5 can be held at either an outwardly forwarded position or an inwardly retained position in a stable manner. As is apparent from the above, the moving direction of the comb portion 5 is approximately perpendicular to the slide direction of the operation plate 15. Thus, the comb portion 5 is adjusted to its height position by a component of a force generally perpendicular to the direction of adjusting height. This eliminates the problem that the comb portion 5 is moved toward the hair cutting portion 3 by a load imparted to the comb portion 5 during usage.

Figure 6:
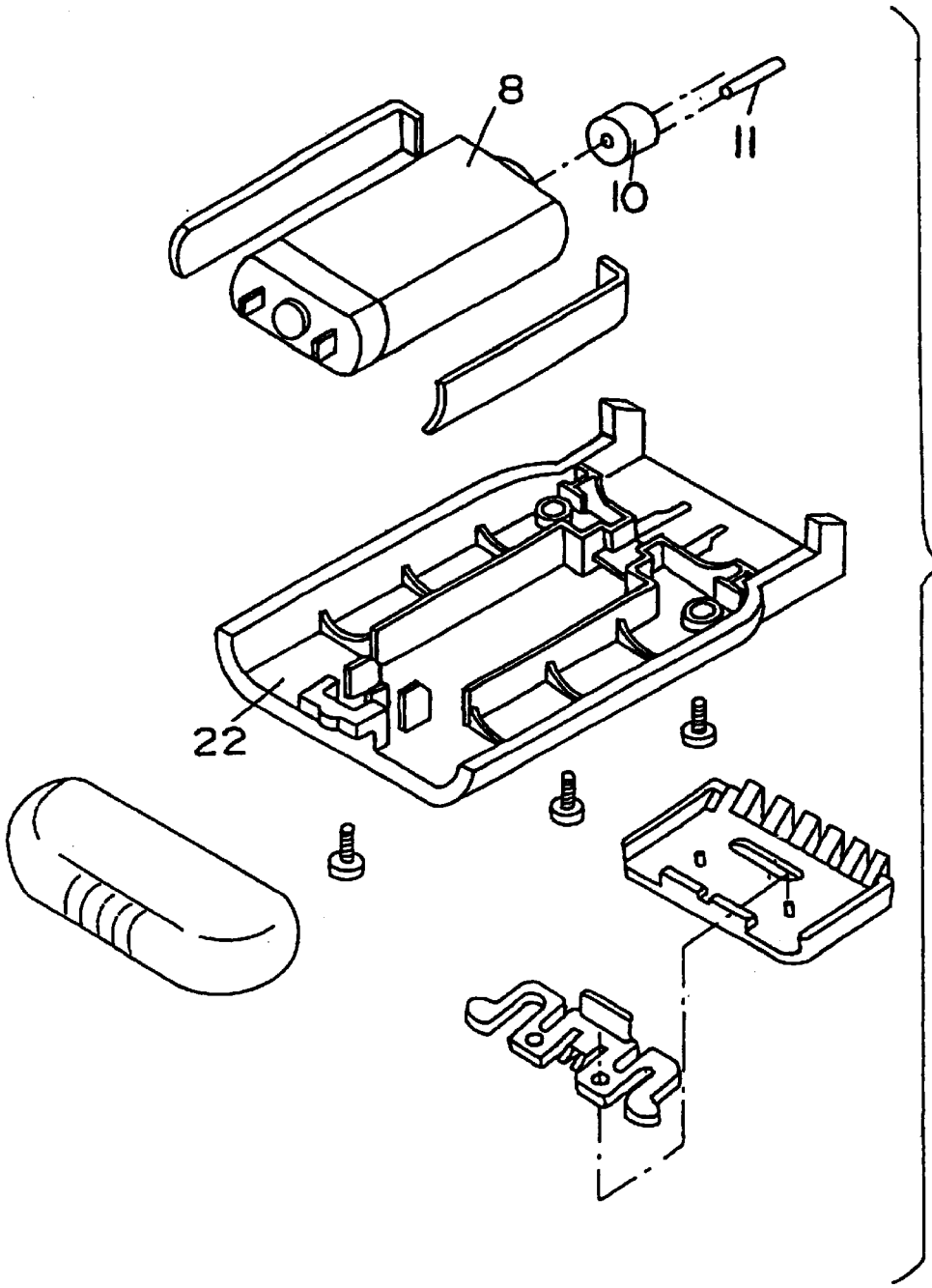
FIG. 6 is an exploded perspective view showing parts of the hair cutter shown in FIG. 1 in a disassembled state.

The hair cutter body 4 is divided into a pair of half housings 12, as shown in FIGS. 5 and 6. As shown in FIG. 5, one of the half housings 12 has a pair of engaging ledges 21 at a laterally central portion of the outer surface thereof. A disc-shaped axial member 27 is held by the engaging ledges 21. As later described, the center of the axial member 27 is a rotation axis around which the comb portion holder 7 rotates.

The supporting plate 7*a* of the comb portion holder 7 is provided with an elongated opening 23 extending in the lengthwise direction. The disc-shaped axial member 27 is rotatably engaged with the elongated opening 23 and is allowed to slide in the longitudinal direction thereof.

Figure 7B:
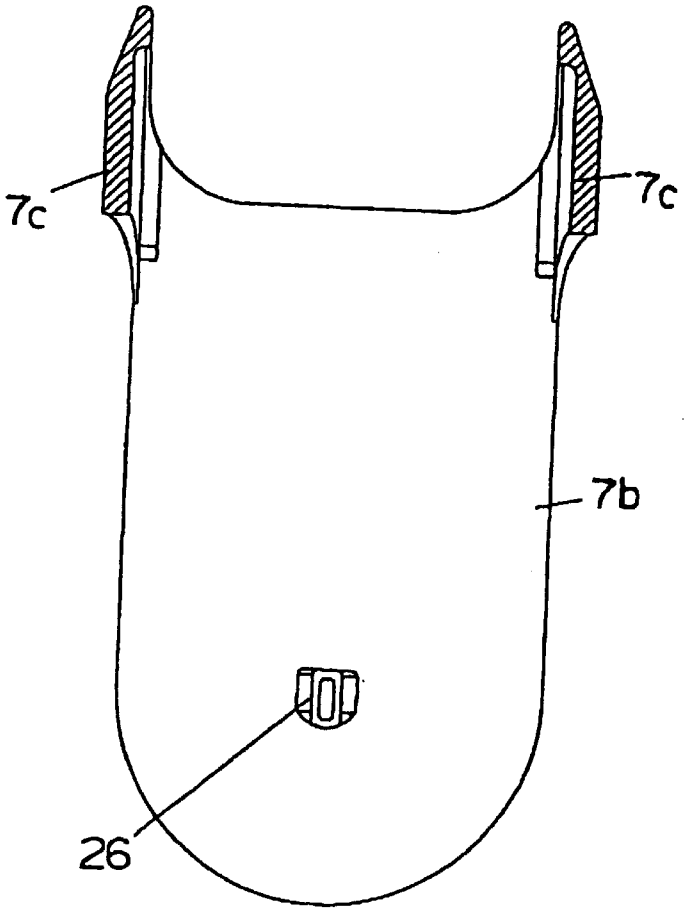
FIG. 7B is a front elevation view of the comb portion holder.
Figure 7A:
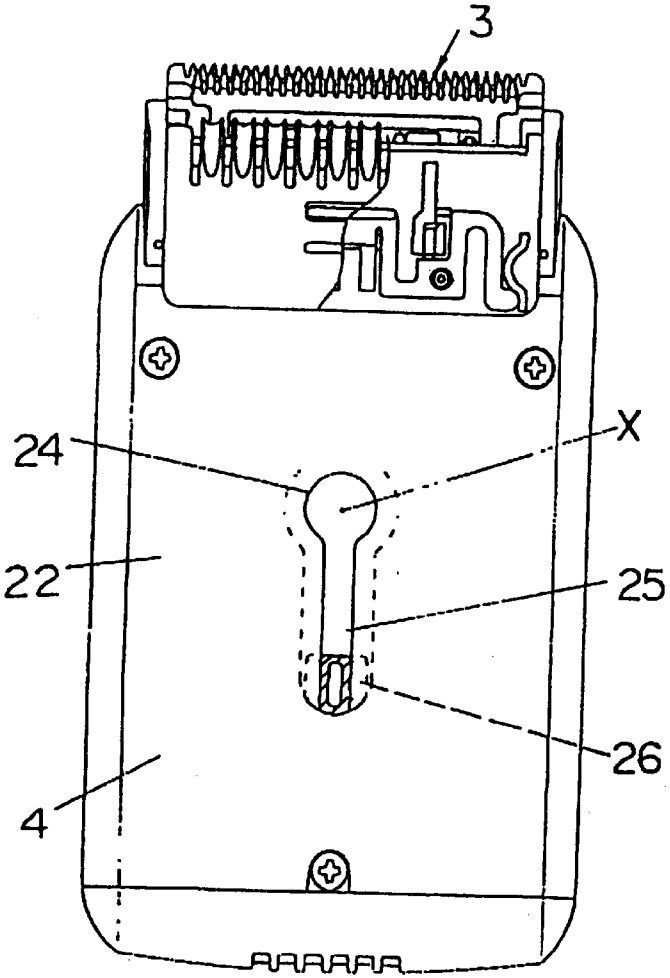
FIG. 7A is a front elevation view of the hair cutter body shown in FIG. 1 from which a comb portion holder is detached.
Figure 8:
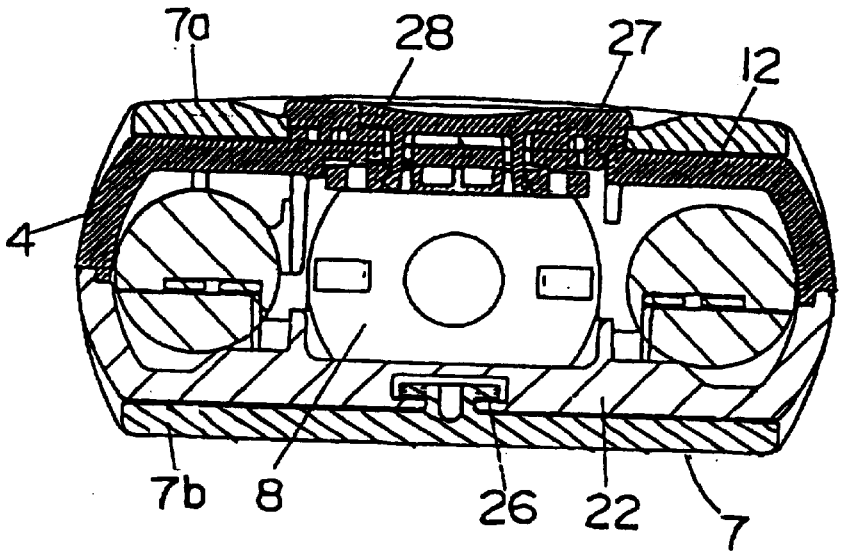
FIG. 8 is a cross-sectional view of the hair cutter shown in FIG. 1.

As shown in FIG. 7A, the other half housing 22 is provided with a circular dented portion 24 located at a position corresponding to the disc-shaped axial member 27 and a slide groove 25 extending from the circular dented portion 24 in the longitudinal direction of the half housing 22. On the other hand, as shown in FIG. 7B, the other supporting plate 7*b* has, at its inner surface, an inwardly protruded sliding and rotating axial member 26 having a rectangular cross-sectional shape. The axial member 26 is engaged with the slide groove 25 in an non-rotatable and non-detachable manner. When the axial member 26 is positioned at the circular dented portion 24, the comb portion holder 7 is allowed to rotate about the rotation axis X.

As is apparent from the above explanation, the comb portion holder 7 is connected to the hair cutter body 4 such that the holder 7 is allowed to slide in the longitudinal direction of the hair cutter body 4 with the axial members 26 and 27 engaged with the slide groove 25 and the elongated opening 23, respectively.

Figure 1B:
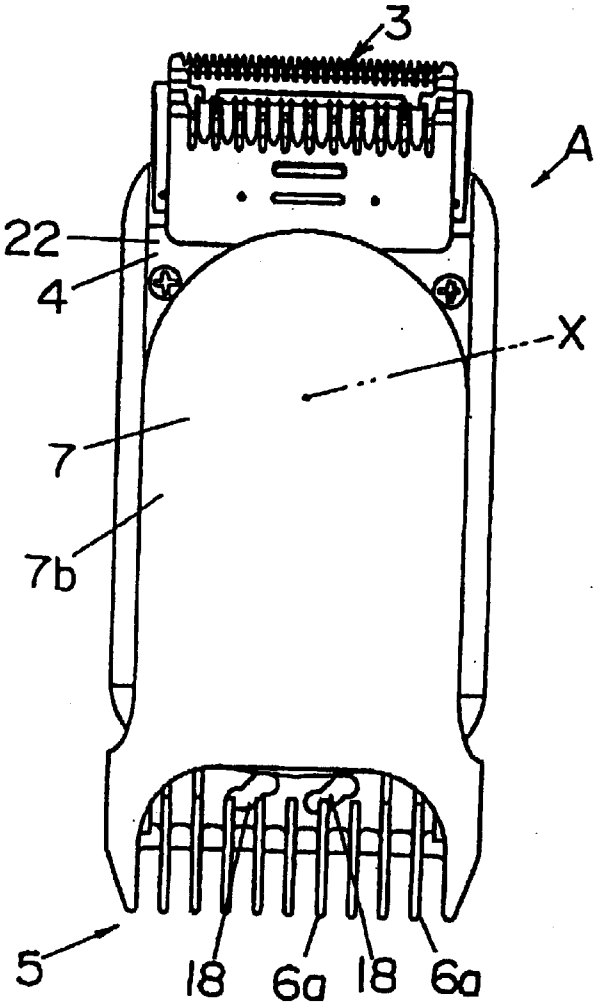
FIG. 1B is a rear view of FIG. 1A.
Figure 1A:
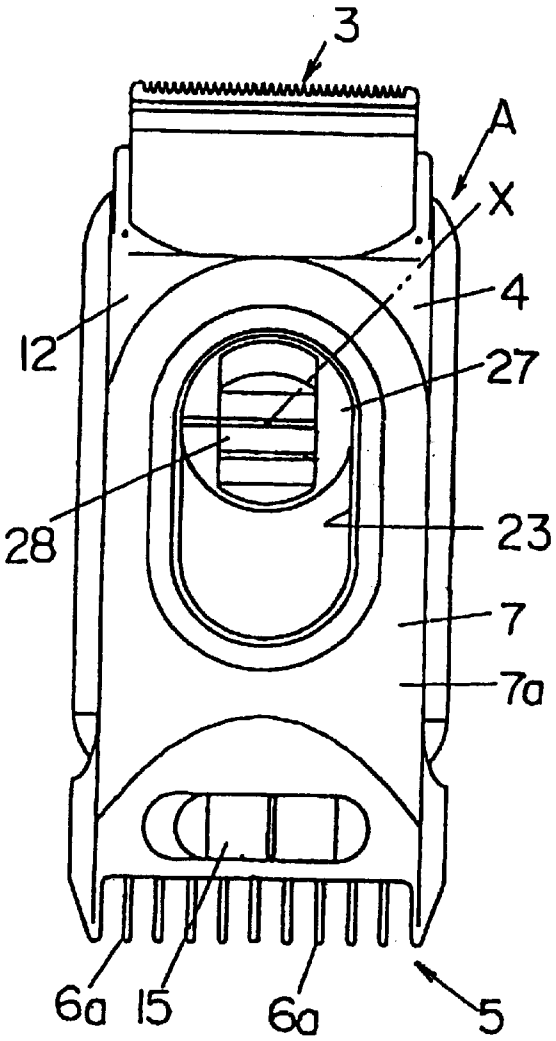
FIG. 1A is a front elevation view of a hair cutter according to an embodiment of the present invention.
Figure 2B:
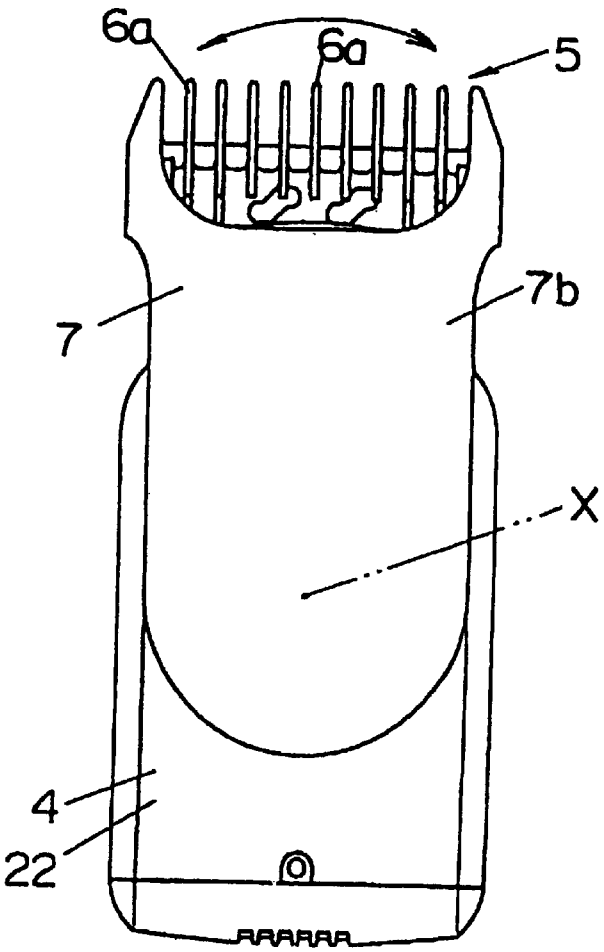
FIG. 2B is a rear view of FIG. 2B.
Figure 2A:
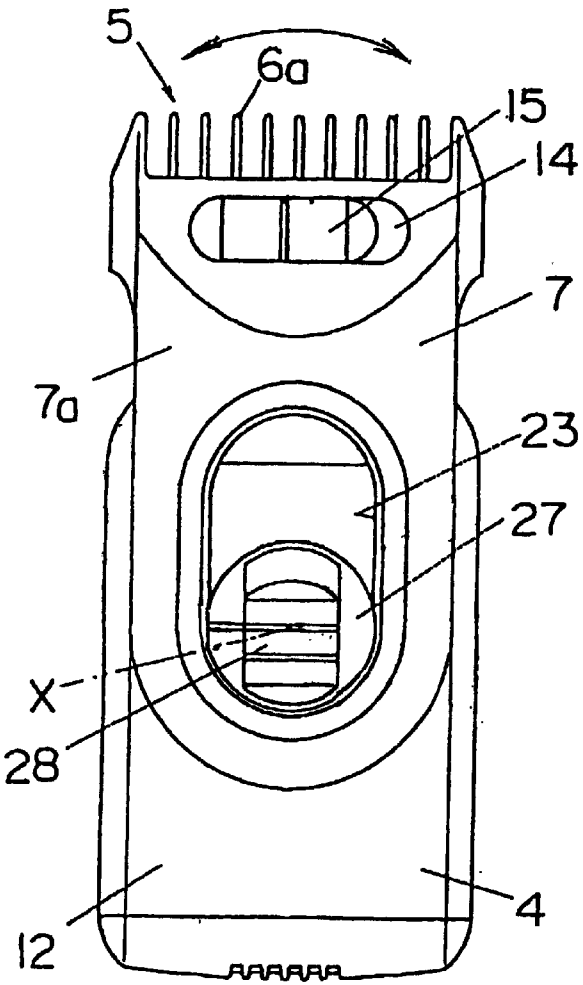
FIG. 2A is a front elevation view of the hair cutter shown in FIG. 1 in a state that the comb portion is moved upward from a comb-use-position.

As shown in FIGS. 2A and 2B, when the comb portion holder 7 is slid upwardly, the disc-shaped axial member 27 is located at the lower end portion of the elongated opening 23 and the axial member 26 is located at the circular dented portion 24. In this state, the comb portion holder 7 is allowed to rotate in the direction of arrows shown in FIGS. 2A and 2B. From the state shown in FIGS. 2A and 2B, when the comb portion holder 7 is rotated by 180 degrees, the comb portion holder 7 takes a non-comb-use-position where the comb portion 5 is positioned at the other end portion of the hair cutter body 4 with the hair cutting portion 3 exposed, as shown in FIGS. 1A and 1B. In this state, the user can cut his or her hair with the exposed hair cutting portion 3. In order to prevent the comb portion holder 7 from unintentionally rotating from the non-comb-use-position, the comb portion holder 7 and the hair cutter body 4 may be provided with positioning members.

Figure 3C:
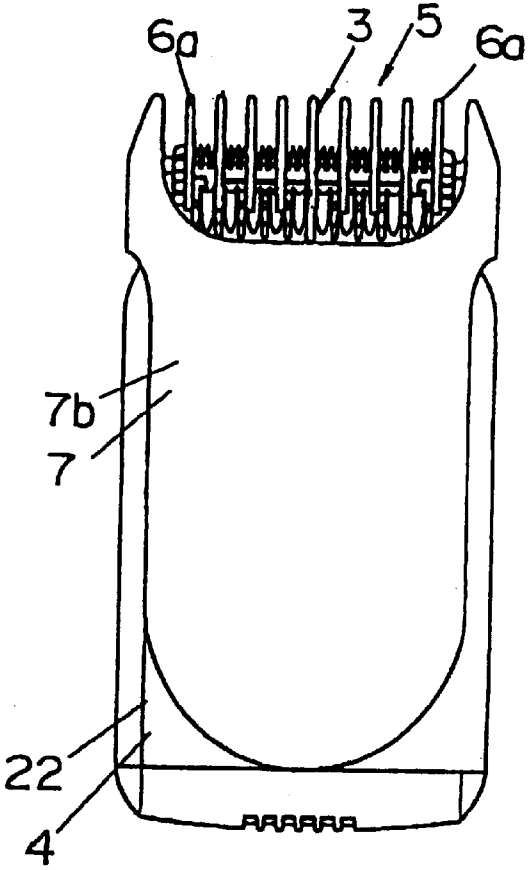
FIG. 3C is a rear view of FIG. 3A.
Figure 3B:
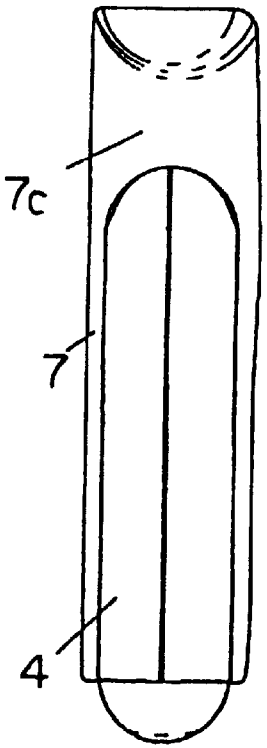
FIG. 3B is a left side view of FIG. 3A.
Figure 3A:
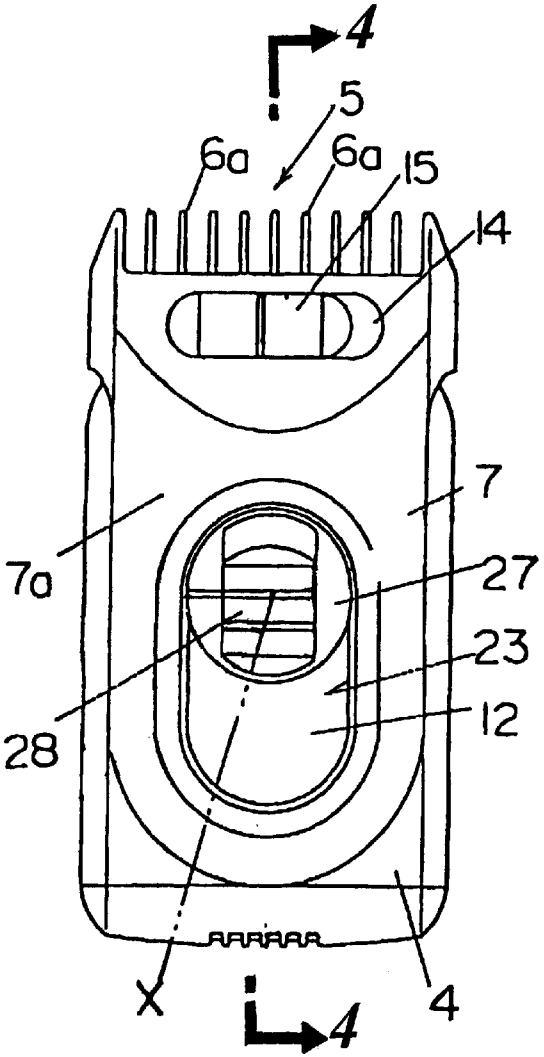
FIG. 3A is a front elevation view of the hair cutter shown in FIG. 1 in a state that the comb portion holder is in a comb-use-position.

From the rotation-allow-position shown in FIGS. 2A and 2B, when the comb portion holder 7 is slid toward the hair cutter body 4, the disc-shaped axial member 27 is located at the upper end portion of the elongated opening 23 and the axial member 26 is located at the lower end portion of the slide groove 25, as shown in FIGS. 3A and 7A. In this state, the comb portion holder 7 takes a comb-use-position where the hair cutting portion 3 is covered by the comb portion 5. In this state, the comb portion holder 7 is prevented from rotating relative to the hair cutter body 4 because the axial member 26 having a rectangular cross-section is engaged with the slide groove 25 in a non-rotatable manner, as shown in FIG. 7A. When the comb portion holder 7 takes a comb-use-position, the height of the comb portion 5 from the hair cutting portion 3 can be adjusted by sliding the operation plate 15, which enable to adjust the length of hairs to be cut. Since the adjustment of the length of hair to be cut can be performed by sliding the comb portion 5 in relation to the comb portion holder 7, the adjusting operation can be enhanced as compared to a structure that a comb portion is moved together with a comb portion holder. In order to prevent the comb portion holder 7 in the comb-use-position from unintentionally sliding, the comb portion holder 7 and the hair cutter body 4 may have positioning means.

In a case where the comb portion holder 7 takes the comb-use-position, the user can cut his or her hair at a length adjusted by the comb portion 5. When the hair cutter is in use in this state, although a load opposite to the moving direction of the comb portion 5, i.e., a load perpendicular to the reciprocating direction of the movable blade 2, is imparted to the comb portion 5, the comb portion holder 7 is not allowed to rotate by the load because the comb portion holder 7 is allowed to rotate only in a plane parallel to the side surfaces of the hair cutter body 4 located along the direction of thickness. This prevents the hair cutting portion 3 from unintentionally being exposed.

As shown in FIGS. 4 and 5, a switch plate 28 is slidably fitted in a dented portion 30 of the disc-shaped axial member 27 through slits 29 and engaged with a switch basal member 32. By sliding the switch plate 28 to operate a contacting metal member 31, the power supply to the motor 8 is controlled, which in turn controls the operation of the movable blade 2. In FIG. 5, the reference numerals 41, 42 and 43 denote a battery negative contact member, a battery positive contact member, and a motor positive contact member, respectively.

FIGS. 10 to 13 show a hair cutter according to the second embodiment of the present invention.

Although the hair cutter has the same fundamental structure as that of the above-mentioned embodiment, the hair cutter is different from the above-mentioned embodiment in that positioning means for positioning the comb portion holder 7 relative to the hair cutter body 4 is provided. Accordingly, the explanation of the same portion as in the above-mentioned embodiment will be omitted by allotting the same reference numerals.

The hair cutter according to the second embodiment is provided with a first positioning member 33 for positioning the comb portion holder 7 relative to the hair cutter body 4 and giving a click feeling to the user when the comb portion holder 7 is rotated to a certain position and a second positioning member 34 for positioning the comb portion holder 7 relative to the hair cutter body 4 and giving a click feel to the user when the comb portion holder 7 is linearly slid into a position.

Figure 10:
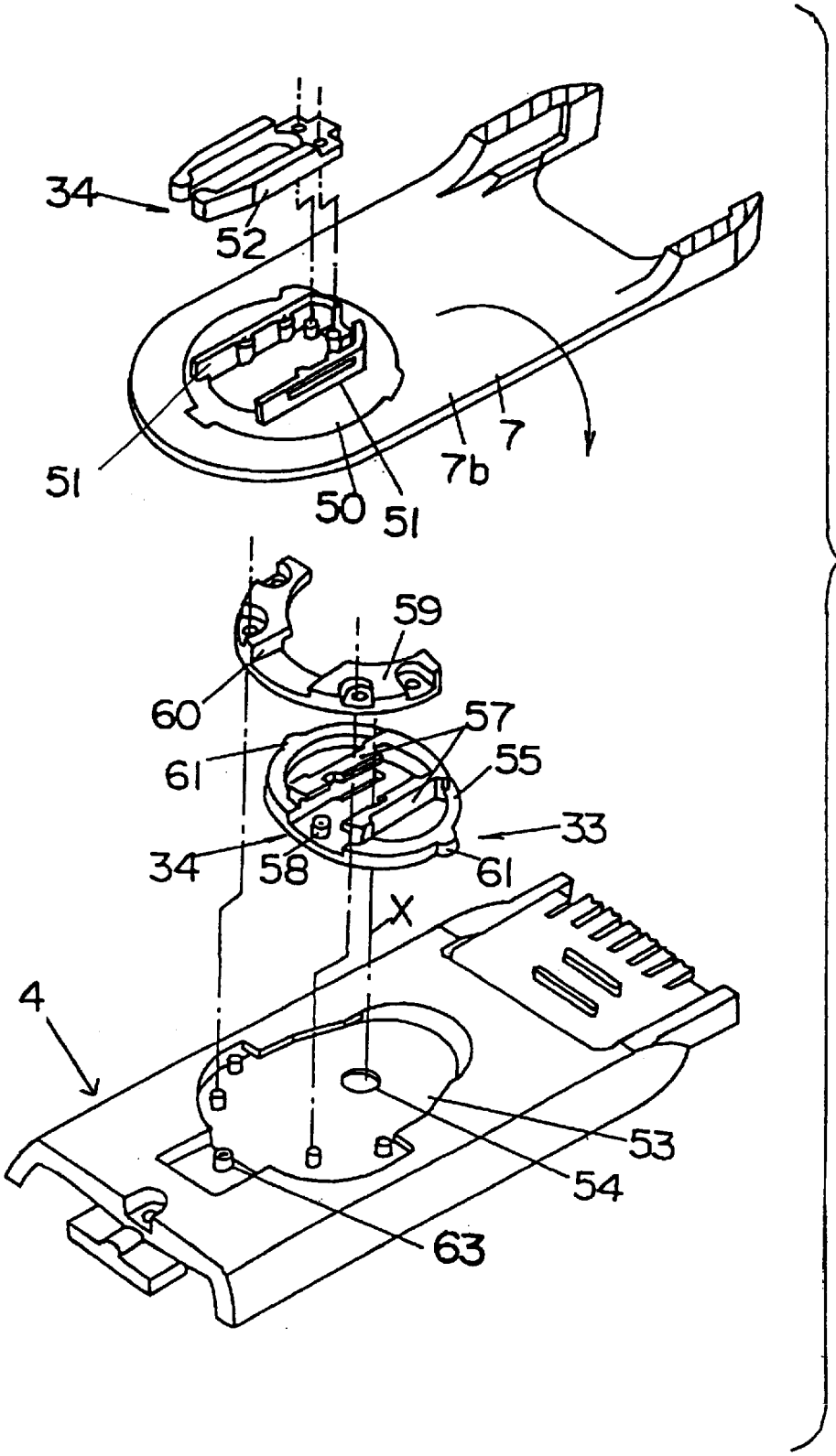
FIG. 10 is an exploded perspective view of a hair cutter according to another embodiment of the present invention.
Figure 11:
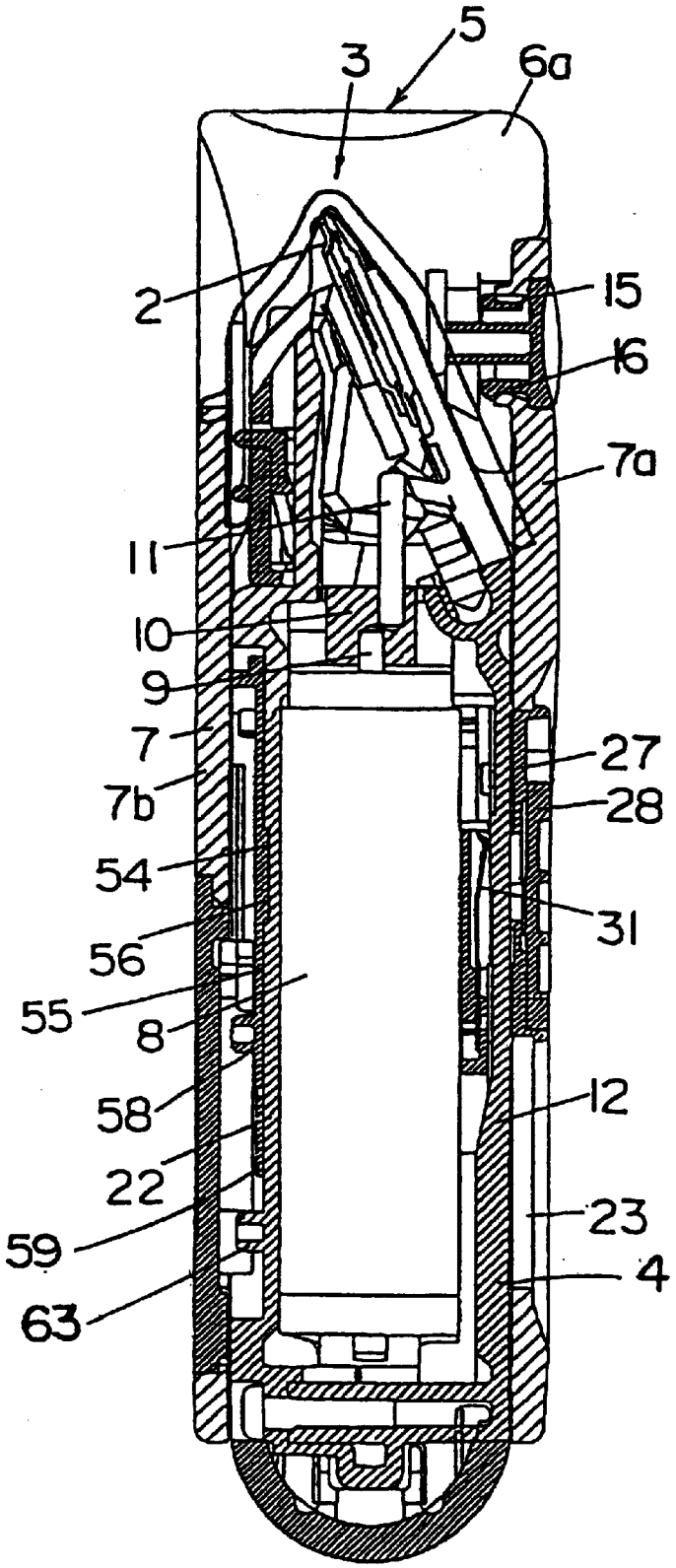
FIG. 11 shows a vertical cross-sectional view of the hair cutter shown in FIG. 10.
Figure 12B:
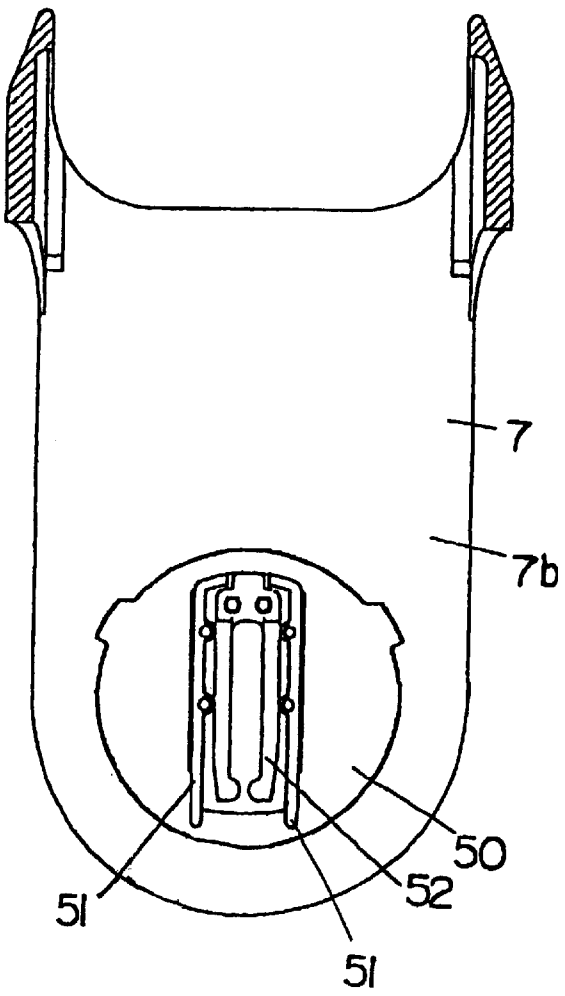
FIG. 12B is a front elevation view of the comb portion holder.

As shown in FIGS. 10 and 12B, one of the supporting plates 7*b* of the comb portion holder 7 is provided with a generally circular opening in which a lid member 50 having a configuration corresponding to the opening is fixedly fitted. The lid member 50 has a pair of rib-shaped inner holders 51 disposed in parallel with each other at a distance. Between the inner holders 51, a generally U-shaped slide click ledge 52 constituting the second positioning means is fixed.

Figure 12A:
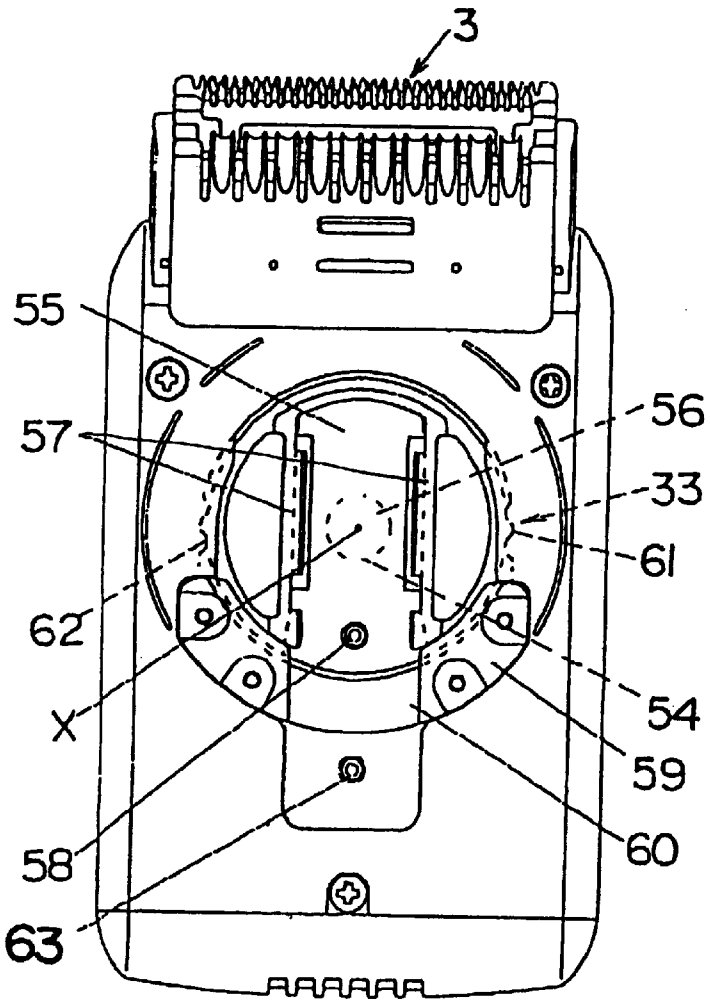
FIG. 12A is a front elevation view of the hair cutter body of FIG. 10.
Figure 13:
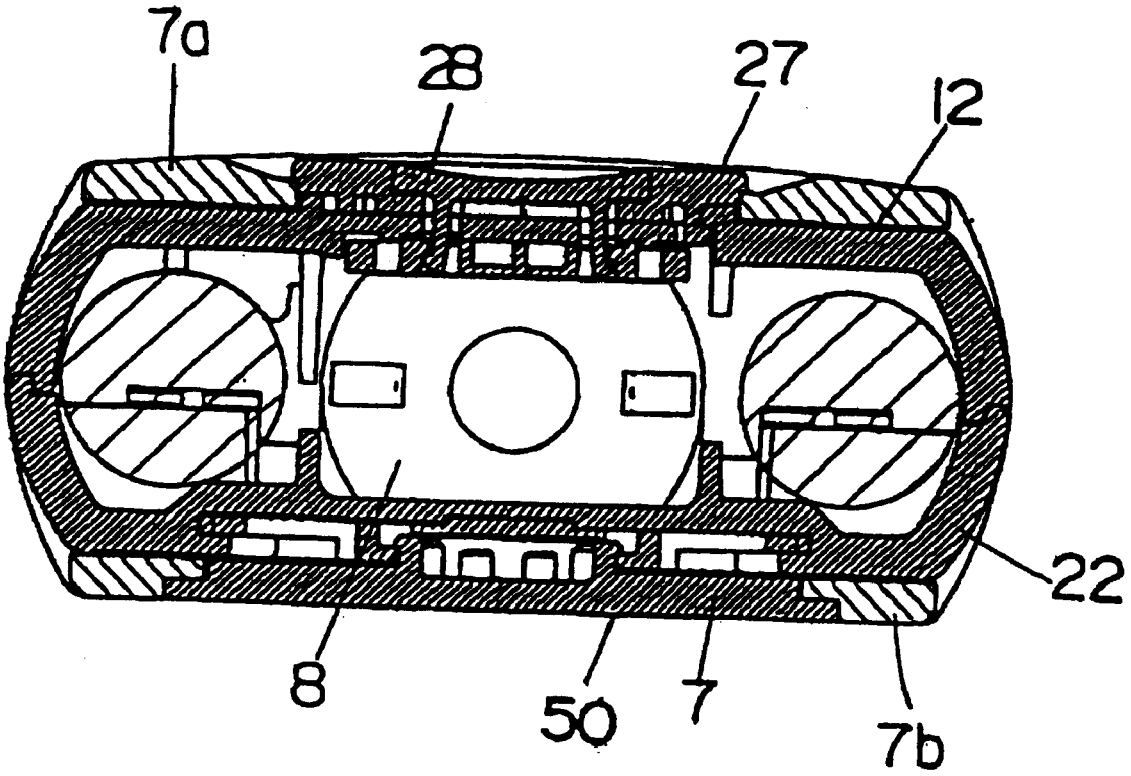
FIG. 13 is a cross-sectional view of the hair cutter shown in FIG. 10.
Figures 14A, 14B, 14C:
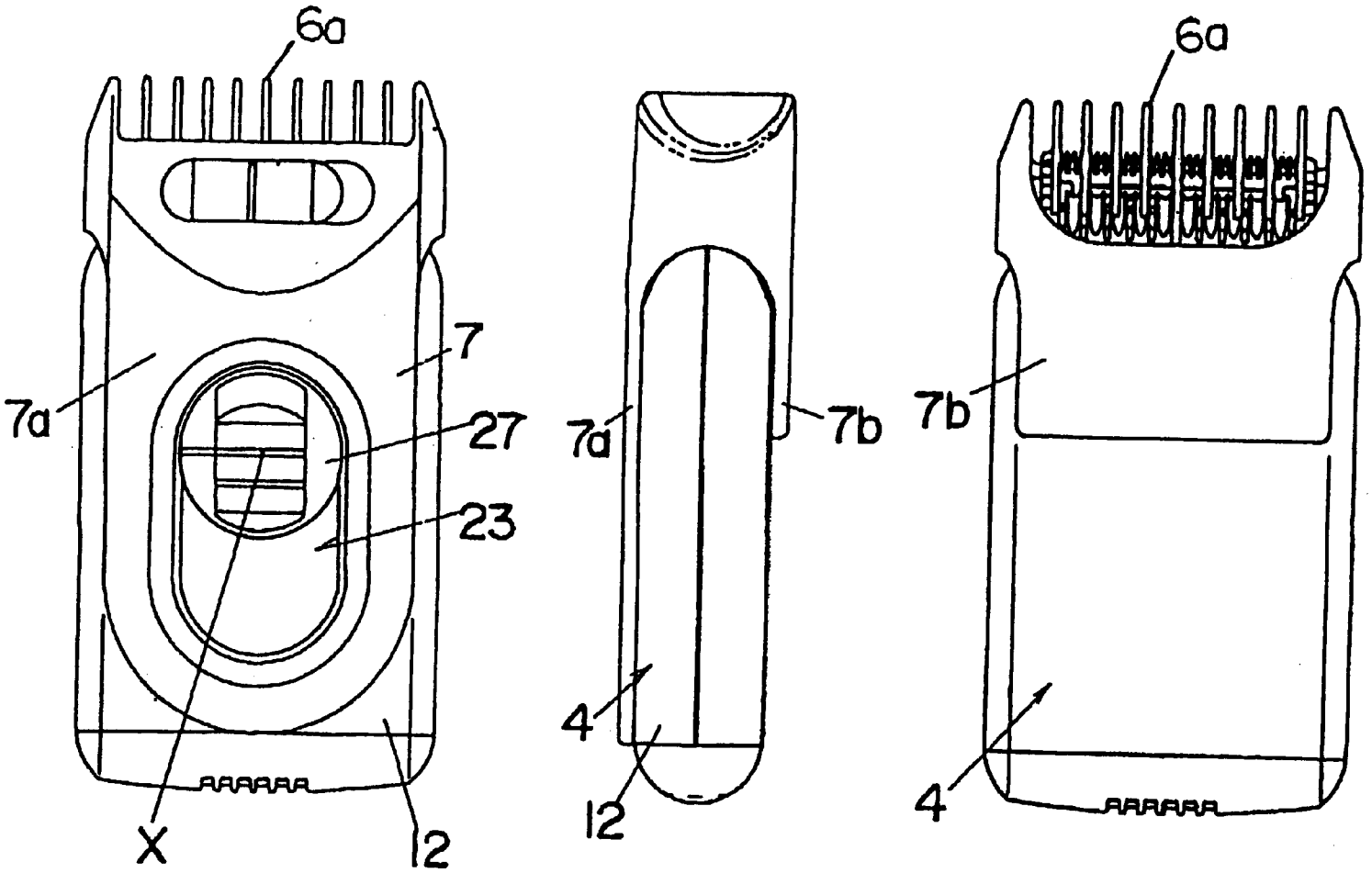
FIG. 14A is a front elevation view of a hair cutter according to still another embodiment of the present invention.
FIG. 14B is a left side view of FIG. 14A.
FIG. 14C is a rear view of FIG. 14A.

On the other hand, as shown in FIGS. 10 and 12A, the hair cutter body 4 is provided with a dented portion 53. In the dented portion 53, a circular dented portion 54 is further formed. A rotation click plate 55 having a circular ring portion, which constitutes the first positioning member 33, is fitted in the dented portion 53, and a protrusion 56 formed on the lower surface of the rotation click plate 55 is fitted in the circular dented portion 54 so that the rotation click plate 55 can be rotated relative to the hair cutter body 4. The rotation click plate 55 has, at its upper surface, a pair of rib-shaped outer holders 57, 57 disposed parallel with each other at a certain interval and an cylindrical protrusion 58 formed between end portions of the outer holders 57. Between the outer holders 57, the inner holders 51 are fitted.

When the comb portion holder 7 is slid relative to the hair cutter body 4 to engage or disengage the slide click ledges 52 with the cylindrical protrusion 58, the comb portion holder 7 is positioned relative to the hair cutter body 4 at the comb-use-position where the comb portion 5 covers the hair cutting portion 3 or a holder-rotate-position where the comb portion 5 is apart from the hair cutting portion 3 with a click feeling.

The rotation click plate 55 has, at its outer periphery, outwardly protruded resilient protrusions 61 for engaging with dented portions 62 formed on an inner peripheral surface of the dented portion 53 of the hair cutter body 4. Thus, the comb portion holder 7 can be positioned relative to the hair cutter body 4 at the comb-use-position or the non-comb-use-position with a click sensation.

A semi-circular holding plate 59 having a slide groove 60 at the circumferentially central portion thereof is fixedly fitted in one end portion of the dented portion 53 of the hair cutter body 4 so as to surround the rotation click plate 55. Therefore, as shown in FIG. 12A, in a state that the outer holders 57 is in alignment with the slide groove 60 of the semi-circular holding plate 59, the inner holders 51 held between the outer holders 57 are allowed to slidably moved into the slide groove 60. Thus, the comb portion holder 7 can take the comb-use-position. When the comb portion holder 7 takes the comb-use-position, the slide click ledges 52 are engaged with another cylindrical protrusion 63 formed on the hair cutter body side with a click sensation.

With the above-mentioned construction, an appropriate click sensation can be obtained not only when rotating the comb portion holder 7 but also when sliding the comb portion holder 7, resulting in an easy operation.

In this embodiment, since the comb portion holder 7 is allowed to rotate only in a plane parallel to the side surfaces located in the direction of thickness of the hair cutter body 4, the comb portion holder 7 is prevented from unintentionally rotating to expose the hair cutting portion 3 when the comb portion is in use.

FIGS. 14 to 17 show still another embodiment according to the present invention. In this embodiment, since the hair cutter has the same fundamental structure as that of the above-mentioned embodiments, the explanation of the same portion as in the above-mentioned embodiments will be omitted by allotting the same reference numerals.

Figure 15:
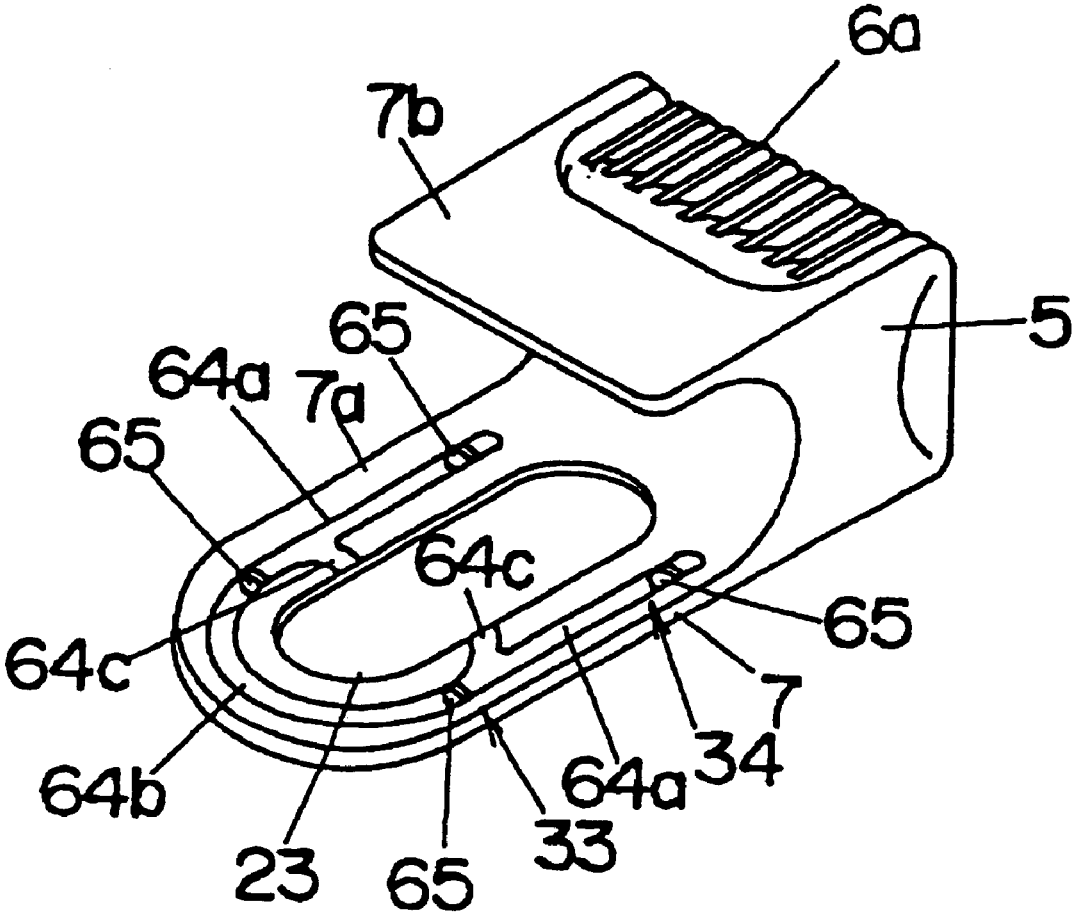
FIG. 15 is a perspective view of the comb portion holder of the hair cutter shown in FIG. 14A.
Figure 16:
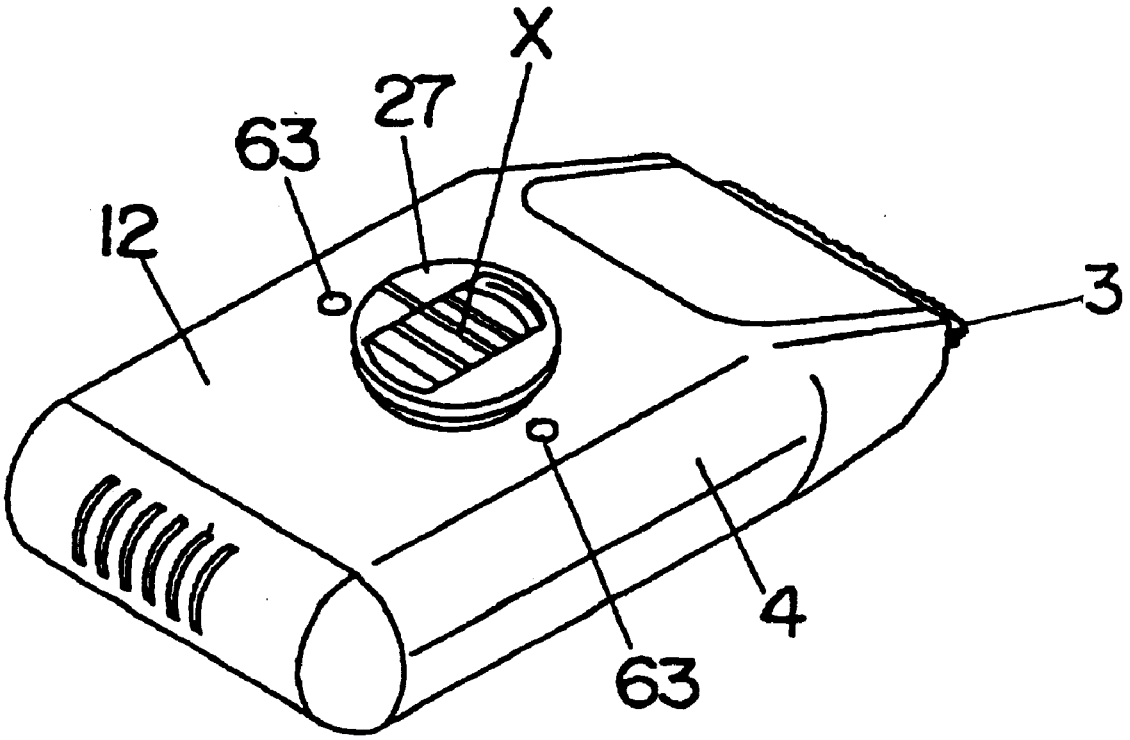
FIG. 16 is a perspective view of the hair cutter body shown in FIG. 14A.
Figure 17:
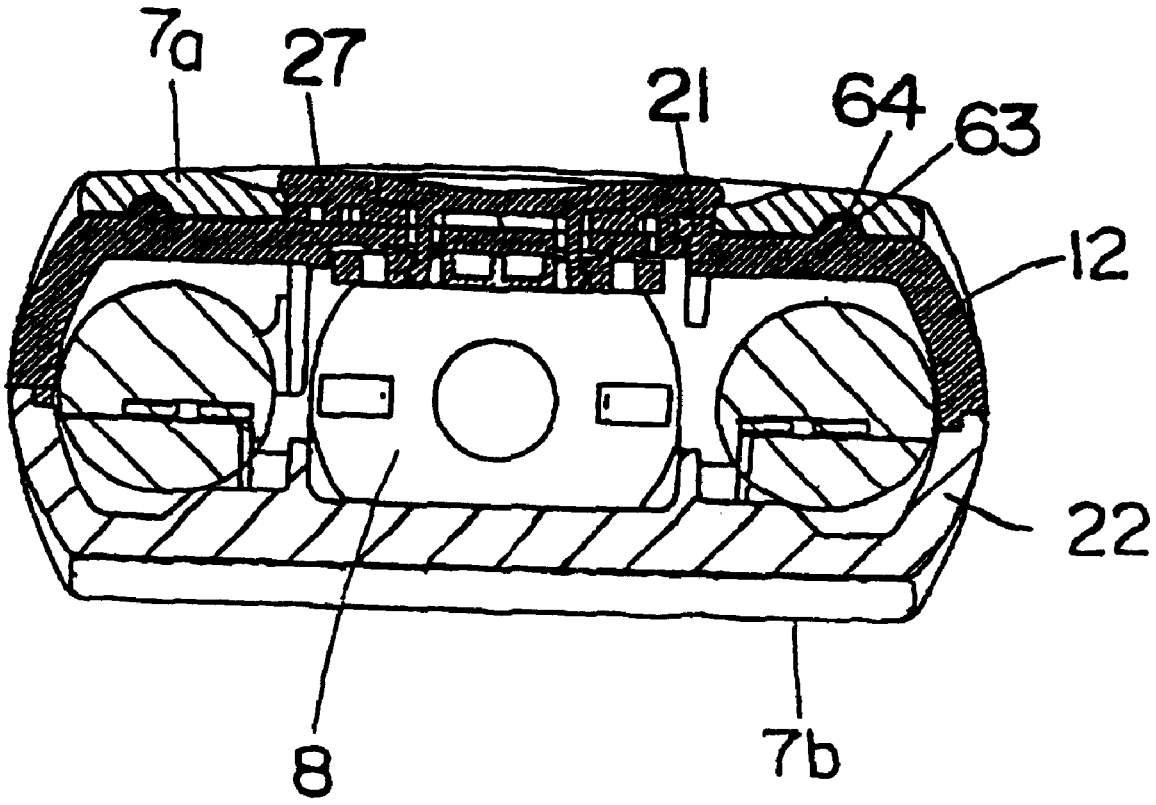
FIG. 17 is a cross-sectional view of the hair cutter shown in FIG. 14A.
Figure 18:
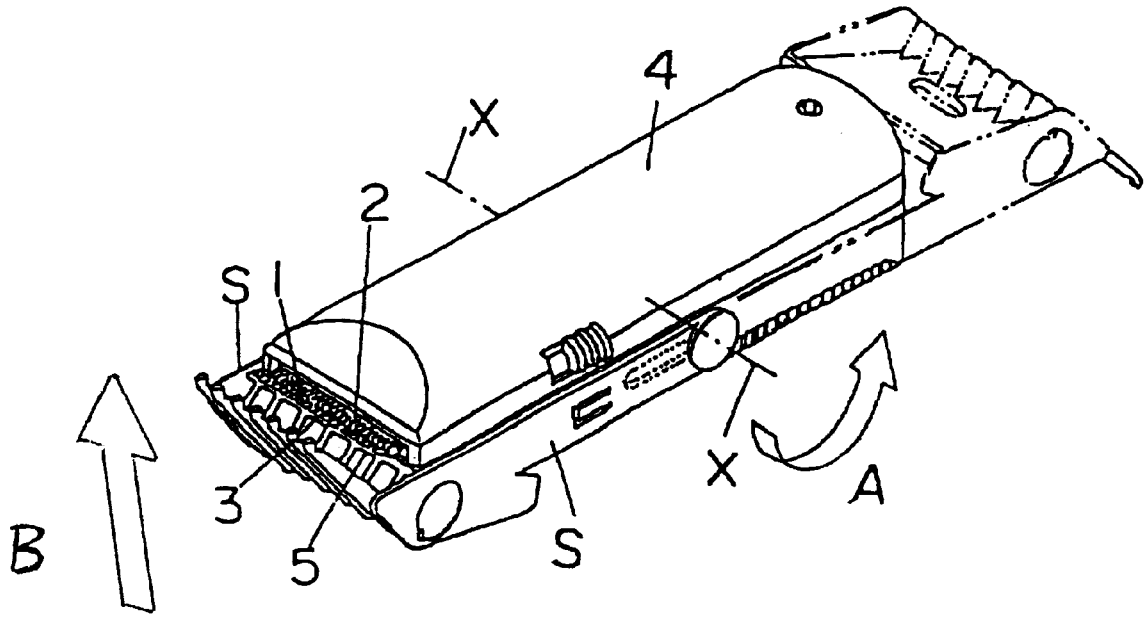
FIG. 18 (PRIOR ART)
FIG. 18 is a perspective view of a conventional hair cutter.

In this embodiment, as shown in FIGS. 15 and 16, one of the opposing supporting plates 7*b* is shorter than the other supporting plate 7*a*. The longer supporting plate 7*a* has an elongated opening 23 with which the basal smaller diameter portion of the disc-shaped axial member 27 formed on the hair cutter body 4 is rotatably slidably engaged so as not to be detached therefrom. Thus, the comb portion holder 7 can change its position between the comb-use-position where the comb portion 5 covers the hair cutting portion 3 and the non-comb-use-position where the comb portion 5 is located at the other end of the hair cuter body 4 to expose the hair cutting portion 3. In this embodiment, since the comb portion holder 7 is allowed to rotate only in a plane parallel to the side surfaces located in the direction of thickness of the hair cutter body 4, the comb portion holder 7 is prevented from unintentionally rotating to expose the hair cutting portion 3 by a load imparted to the comb portion 5 when the comb portion 5 is in use.

The hair cutter also has a positioning member for positioning the comb portion holder 7 relative to the hair cutter body 4. In detail, as shown in FIG. 16, the housing 12 of the hair cutter body 4 has, at both sides of the disc-shaped axial member 27, a pair of protrusions 63 outwardly protruded on the circumference having a center coincide with the rotation axis X. As shown in FIG. 15, the longer supporting plate 7*a* has, at its inner surface, slide grooves 64*a* and a rotation guide groove 64*b* each extending along the periphery of the elongated opening 23. Further, arc-shaped grooves 64*c* continuing from the rotation guide groove 64*b* are formed so as to open to the elongated opening 23. Thus, in a state that the protrusions 63 of the hair cutter body 4 are engaged with the slide grooves 64*a,* the comb portion holder 7 is allowed to slide along the slide grooves 64*a*. In a state that the disc-shaped axial member 27 is positioned at an end portion opposite to the comb portion 5, since the protrusions 63, 63 are allowed to travel along the rotation guide groove 64*b* and the arc-shaped groove 64*c* and across the elongated opening 23, the comb portion holder 7 can rotate relative to the hair cutter body 4 about the rotation axis X.

In the slide grooves 64*a,* a total of four protrusions 65 are formed at the comb portion side and the opposite side thereof. Thus, when the comb portion holder 7 is rotated or slid, the protrusions 65 leave click sensations to the user when the protrusions 63 of the hair cutter body 4 pass the protrusions 65 of the comb portion holder 7.

As mentioned above, in this embodiment, the rotational click means and slide click means for obtaining a click sensation when positioning the comb portion 5 are simple in construction, resulting in a thin and easy-handling hair cutter.

The terms and expressions which have been employed herein are used as terms of description and not of limitation, and there is no intent, in the use of such terms and expressions, of excluding any equivalents of the features shown and described or portions thereof, but it should be recognized that various modifications are possible within the scope of the invention claimed.

This application claims priority of Japanese Patent Application No. Hei 10-167525, the disclosure of which is incorporated by reference in its entirety.

What is claimed is:

1. A haircutter, comprising:

a hair cutter body of a generally rectangular cross-section having a thickness and a width greater than the thickness, said hair cutter body having opposing outer surfaces spaced apart from one another in a direction of the thickness;

a hair cutting portion provided at one end of said hair cutter body, said hair cutting portion including a comb-like fixed blade and a comb-like movable blade, said blades disposed laterally along said end, said movable blade being reciprocable in said lateral direction with respect to said fixed blade;

a comb portion having a plurality of comb plates for covering said hair cutting portion; and a comb portion holder having said comb portion at one end thereof, wherein said comb portion holder has at least one supporting member fitted on and rotatably attached to one of said outer surfaces, whereby said comb portion holder is rotatable about an axis perpendicular to the lateral orientation of said blades so that said comb portion is movable between a comb-use-position where said comb portion covers said hair cutting portion and a non-comb-use-position where said comb portion is placed at the other end of said hair cuter body with said hair cutting portion exposed.

2. The hair cutter as recited in claim 1, wherein said comb portion holder has a comb holding portion and a pair of supporting members extending from said comb holding portion, said comb portion holder being of generally U-shaped when seen from a side.

3. The hair cutter as recited in claim 1, wherein said comb holder has a comb holding portion and a supporting member extending from said comb holding portion.

4. The hair cutter as recited in claim 1, wherein said comb portion holder is connected to said hair cutter body such that said comb portion holder is allowed to slide in a direction of length of said hair cutter body and to rotate when said comb portion holder is moved from the comb-use-position in the direction of length of said hair cutter body such that said comb portion is away from said hair cutting portion.

5. The hair cutter as recited in claim 4, wherein said hair cutter body has a protrusion as a rotation axis on one of said outer surfaces, wherein said at least one supporting member is provided with an elongated opening extending along a length of said at least one supporting member into which said protrusion is fitted, and wherein said comb portion holder is allowed to rotate about said protrusion relative to said hair cutter body when said protrusion is located at one end of said elongated hole.

6. The hair cutter as recited in claim 5, wherein said protrusion is formed to be a circular disc having a decreased diameter portion at a basal end thereof, and wherein said decreased diameter portion is fitted in said elongated opening.

7. The hair cutter as recited in claim 1, wherein said at least one supporting member is provided with a protrusion as a rotation axis on an inner surface of said at least one supporting member, wherein said hair cutter body is provided with a slide groove extending along a length of said hair cutter body into which said protrusion is fitted, and wherein said comb portion holder is allowed to rotate about said protrusion relative to said hair cutter body when said protrusion is located at one end of said slide groove.

8. The hair cutter as recited in claim 1, further comprising slide positioning means for positioning said comb portion holder relative to said hair cutting body with a click sensation at the comb-use-position and at a comb-rotatable-position where said comb portion is away from said hair cutting portion and is allowed to rotate, when said comb portion holder is slid relative to said hair cutter body along a longitudinal direction of said hair cutter body.

9. The hair cutter as recited in claim 1, further comprising rotation positioning means for positioning said comb portion holder relative to said hair cutting body with a click sensation at a comb-rotatable-position where said comb portion is away from said hair cutting portion and is allowed to rotate and at the comb-use-position, when said comb portion holder is rotated relative to said hair cutter body.

10. The hair cutter as recited in claim 1, further comprising:

slide positioning means for positioning said comb portion holder relative to said hair cutting body with a click sensation at the comb-use-position and at a comb-rotatable-position where said comb portion is away from said hair cutting portion and is allowed to rotate, when said comb portion holder is slid relative to said hair cutter body along a longitudinal direction of said hair cutter body; and rotation positioning means for positioning said comb portion holder relative to said hair cutting body with a click sensation at a comb-rotatable-position where said comb portion is away from said hair cutting portion and is allowed to rotate and at the comb-use-position, when said comb portion holder is rotated relative to said hair cutter body.

11. The hair cutter as recited in claim 10, wherein said slide positioning means and said rotation positioning means are separate members.

12. The hair cutter as recited in claim 1, wherein each of said plurality of comb plates is arranged in a direction perpendicular to the lateral reciprocation direction of said movable blade.

13. The hair cutter as recited in claim 1, wherein a height of said plurality of comb plates from a tip end of said hair cutting portion is adjustable.

14. A hair cutter, comprising:

a hair cutter body having a thickness and a width substantially greater than the thickness thereof;

a hair cutting portion provided at one longitudinal end of said hair cutter body; and a comb portion holder having a comb portion including a plurality of comb plates at one end of said comb portion holder, said comb portion being capable of covering said hair cutting portion, wherein said comb portion holder is connected to said hair cutter body such that said comb portion holder is rotatable about an axis parallel to a thickness direction thereof, whereby said comb portion is movable between a comb-use-position where said comb portion covers said hair cutting portion and a non-comb-use-position where said comb portion is placed at the other end of said hair cuter body with said hair cutting portion exposed.

15. A hair cutter, comprising:

a hair cutter body;

a hair cutting portion provided at one end of said hair cutter body said hair cutting portion having cutting blades disposed laterally along said one end; and a comb portion holder having a comb portion at one end thereof, wherein said comb portion holder is connected to said hair cutter body such that said comb portion holder is rotatable about an axis generally parallel to a direction of load imparted to said comb holder when in use, said load being imported to said comb holder in a direction generally perpendicular to said laterally disposed cutting blades whereby said comb portion is movable between a comb-use-position where said comb portion covers said hair cutting portion and a non-comb-use-position where said comb portion is placed at the other end of said hair cuter body with said hair cutting portion exposed.

16. The hair cutting as recited in claim 15, wherein said hair cutting blades includes a comb-like fixed blade and a comb-like movable blade reciprocating with respect to said comb-like fixed blade, wherein said comb portion includes a plurality of comb plates, each of said plurality of comb plates being arranged in a direction perpendicular to a direction of reciprocative movements of said movable blade, and wherein said comb portion holder is connected to said hair cutter body so as to rotate about an axis perpendicular to the reciprocative movements of said movable blade.

* * * * *